United States Patent [19]

Cyron

[11] Patent Number: 4,818,746

[45] Date of Patent: Apr. 4, 1989

[54] METAL CATALYST CARRIER OR SUPPORT BODY ROLLED OR LAMINATED FROM METAL SHEETS AND HAVING A DOUBLE OR MULTIPLE CORRUGATED OR WAVE STRUCTURE

[75] Inventor: Theodor Cyron, Bergisch Gladbach, Fed. Rep. of Germany

[73] Assignee: Interatom GmbH, Bergisch Gladbach, Fed. Rep. of Germany

[21] Appl. No.: 913,503

[22] Filed: Sep. 29, 1986

[30] Foreign Application Priority Data

Sep. 30, 1985 [DE] Fed. Rep. of Germany ..... 3534904

[51] Int. Cl.[4] ..... B01J 21/04

[52] U.S. Cl. ..... 502/527; 502/439

[58] Field of Search ..... 502/439, 527

[56] References Cited

U.S. PATENT DOCUMENTS

| | | | |
|---|---|---|---|
| 2,644,777 | 7/1953 | Havens . | |
| 2,887,456 | 5/1959 | Halford et al. | 502/527 X |
| 3,208,131 | 9/1965 | Ruff et al. | 502/527 X |
| 3,528,783 | 9/1970 | Hoselden | 502/527 X |
| 3,891,575 | 6/1975 | Brautigam et al. | 502/527 X |
| 3,966,646 | 6/1976 | Noakes et al. | 502/527 X |
| 4,098,722 | 7/1978 | Cairns et al. | 502/527 X |
| 4,382,323 | 5/1983 | Chapman et al. . | |

FOREIGN PATENT DOCUMENTS

| | | | |
|---|---|---|---|
| 3312944 | 10/1984 | Fed. Rep. of Germany . | |
| 2759559 | 6/1985 | Fed. Rep. of Germany . | |
| 2321346 | 3/1977 | France . | |
| 2040179A | 8/1980 | United Kingdom | 502/527 |
| 2078146A | 6/1982 | United Kingdom | 502/527 |

*Primary Examiner*—Carl F. Dees
*Assistant Examiner*—William G. Wright
*Attorney, Agent, or Firm*—Herbert L. Lerner; Laurence A. Greenberg

[57] ABSTRACT

A metal catalyst carrier or support body is rolled or laminated from two alternating layers of sheet metal of different structure, wherein the sheet-metal layer, at least in some areas relative to one another, have double or multiple-wave structure, in that one of the layers has a wave structure including at least two superimposed or alternating waves of different wavelength and/or amplitude and/or both layers have wave structures of different wavelength and/or amplitude, by means of which in both cases the number of contact points between the two layers is reduced and the elasticity of the resultant structure is increased, wherein none of the wavelengths is considerably smaller than the wavelenth having the greatest amplitude.

16 Claims, 2 Drawing Sheets

METAL CATALYST CARRIER OR SUPPORT BODY ROLLED OR LAMINATED FROM METAL SHEETS AND HAVING A DOUBLE OR MULTIPLE CORRUGATED OR WAVE STRUCTURE

The invention relates to a metal catalyst carrier or support body rolled or laminated from two alternating layers of sheet matel of different structure.

Catalyst carrier or support bodies of this type are preferably used for cleaning the exhaust gases of internal combustion engines and are accordingly exposed to high thermal stresses.

German Published, Non-Prosecuted Application No. DE-OS 33 12 944 discloses a strain-relieved metal carrier or support housing for exhaust gas catalysts subject to high thermal stress during operation, which includes alternating layers of metal sheets, one sheet being flat and the next corrugated, with connections being provided by a joining technique only at defined points of contact between the two sheet-metal layers. This kind of catalyst carrier or support body can only be produced by labor-intensive soldering and it only has a limited elasticity in its finished state.

German Pat. No. DE-PS 27 59 559 discloses a metal catalyst carrier or support body laminated from two alternating sheet-metal layers, in which the two sheet-metal layers have a different structure. Besides the difficulties in manufacturing the structure described therein, a catalyst carrier or support body of this kind has no special elasticity in response to alternating thermal stresses.

It is accordingly an object of the invention to provide a metal catalyst carrier or support body rolled or laminated from metal sheets and having a double or multiple corrugated or wave structure, which overcomes the hereinafore-mentioned disadvantages of the heretofore-known devices of this general type and which has a certain elasticity in the finished rolled or laminated state, so as to more easily compensate for thermal strains.

With the foregoing and other objects in view there is provided, in accordance with the invention, a metal catalystic carrier or support body, comprising two alternating rolled or laminated layers of sheet metal having different structures at least partially formed of double or multiple corrugations or waves, at least one of the layers having a wave structure with at least two superimposed or alternating waves of different wavelength and/or amplitude, and/or both layers have wave structures of different wavelength and/or amplitude, one of the layers having wave crests some of which contact the other of the layers defining contact points therebetween and at least half of which are spaced from the other of the layers providing a reduced amount of contact points as compared to the greatest possible amount of contact points and a desired elasticity of the resultant structure, and none of the wavelengths being substantially smaller than the wavelength having the gretest amplitude.

The decisive factor is that the two sheet-metal layers have a double or multiple-wave or corrugated structure relative to one another, at least in some areas; this can be attained either by a corresponding corrugation of both sheet-metal layers or by a double or multiple-wave structure of only one of the layers. With this kind of double or multiple-wave structure, the number of contact points between the two sheet-metal layers is reduced and spaces remain between the two sheet-metal layers in some individual areas, so that the elasticity of the resultant structure is decisively improved, while avoiding any impairment of the other properties. The gaps resulting in some areas between the individual sheet-metal layers can even impart additional turbulence to the gases flowing through them, which is highly desirable. As will be explained in further detail in conjunction with the drawings, there are various ways of attaining and describing a double or multiple-wave structure between the layers of sheet metal. The term "wave structure" will be understood herein to mean not only a sinusoidal structure, but any other periodic structure, whether a zig-zag or trapezoidal deformation of the metal sheets. Moreover, the multiple structure does not have to extend over the entire catalys carrier or support body. Elasticity of some areas, in particular the outer layers in the shell or jacket region, is adequate for most applications. In all cases, the wavelength with the greatest amplitude is intended to determine the honeycomb-like structure of the catalyst carrier or support body, while all the other undulations, waves or corrugations have noticeably longer wavelengths, or at least wavelengths that are not substantially shorter. Giveb these conditions, the structures can be produced economically, such by using only one pair of toothed rollers and by providing the honeycomb channels with the desired dimensions, such as approximately 1–3 $mm^2$.

In accordance with another feature of the invention, the of the layers is a flat metal sheet and the other of the layers is a double-corrugated sheet. The term "double-corrugated sheet" means that this metal sheet has two superimposed or alternating undulations of different amplitudes and/or wavelengths.

In accordance with a further feature of the invention, the double-corrugated sheet has the structure of first and second superimposed waves, the first wave having a considerably greater amplitude than the second wave and the second wave having a wavelength being a multiple of one-half the wavelength of the first wave. It has proved to be suitable, for example, to make the ratio of the amplitudes greater than 5:1, preferably approximately 10:1. A suitable ratio for the wavelengths is 3:1, for example; that is, the longer wavelength is six times one-half of the shorter wavelength. However, other ratios are also possible.

In accordance with an added feature of the invention, the double-corrugated sheet has the structure of two alternating waves of different amplitude and perhaps different amplitude and at least one half-wavelength or multiples thereof of each of said waves alternate. This embodiment, explained in greater detail in conjunction with the drawings, partly overlaps with the embodiment described above with regard to the structure of two superimposed waves, so that for such cases, the given conditions are merely described differently. Both embodiments can be produced as follows. In accordance wtih an additional feature of the invention, the double-corrugated sheet has a structure produced by means of intermeshing toothed rollers having different tooth depths. This may be done as long as the circumference of the rollers and the wavelengths involved are suitably matched to one another.

In accordance with yet another feature of the invention, both of the alternating sheet-metal layers have a wave structure, the wave structure of one of the layers having an amplitude being much smaller than the amplitude of the wave structure of the other of the layers, such as one-fifth or one-tenth thereof, and the wave structure of the layer having the smaller amplitude has a wavelength being considerably greater than the wavelength of the wave structure of the layer having the greater amplitude.

A specific ratio of the wavelengths to one another is not necessary, so there is a wide latitude. If the two corrugated sheet-metal layers are rolled up in a spiral, then structure is produced in which points of contact between the two layers occur at certain intervals, while in other regions small gaps remain between the layers. Desired gap widths can be set quite precisely by means of a certain biasing during the rolling process. The spiral rolling produces an irregular structure, which differs from those described with regard to the other features above, since the points of contact of the two layers are more irregularly distributed. Nevertheless, the same effect is attained in terms of elasticity and capacity for thermal stress.

In accordance with a concomitant feature of the invention, the layers are interconnected at the contact points by a joining technique, as brazing.

This embodiment results in advantages which are similar to those described in German Published, Non-Prosecuted Application No. DE-OS 33 12 944, but which can be provided much more simply in the catalyst carrier or support body according to the invention than in the case of single-corrugated metal sheets. Eithe the crests of the waves having greater amplitude can be selectively soldered prior to the rolling process, or the points of contact of the sheet-metal layers are soldered or connected by a joining technique in some other way after the rolling process. A catalyst carrier or support body of this kind simultaneously provides high mechanical stability as well as elasticity. Thermal strains and alternating stresses, to which a catalyst carrier or support body of this kind is subjected, in particular if it is housed in a solid tubular shell or jacket, are absorbed by the elastic structure without damage, thereby decisively increasing the service life of the catalyst carrier or support body.

Other features which are considered as characteristic for the invention are set forth in the appended claims.

Although the invention is illustrated and described herein as embodied in a metal catalyst carrier or support body rolled or laminated from metal sheets and having a double or multiple corrugated or wave structure, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
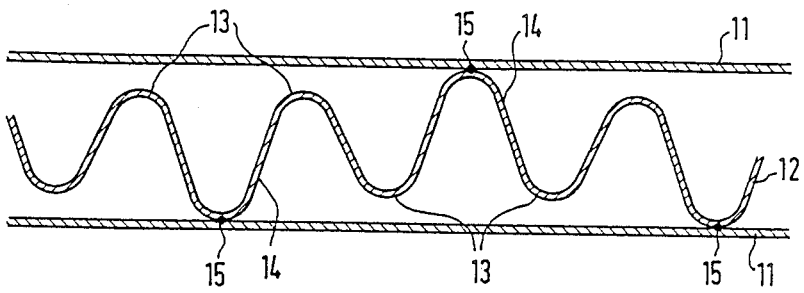
FIG. 1 is a fragmentary, diagrammatic, cross-sectional view of a lamination formed of one flat metal sheet and one double-corrugated or wavy metal sheet, in which the double-wave structure can be described by the superimposition of two waves.
Figure 2:
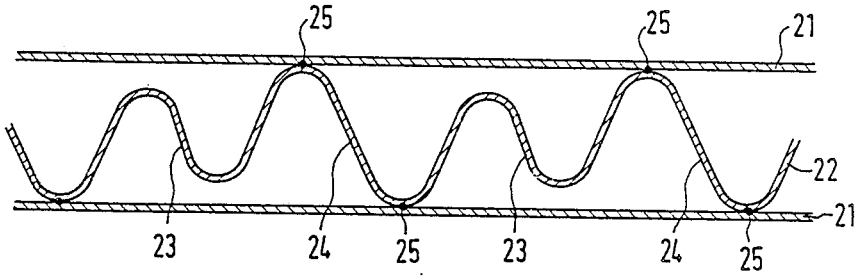
FIG. 2 is a view similar to FIG. 1, of a lamination formed of one flat and one double-corrugated or wavy metal sheet, in which the double-wave structure can be described by alternating waves of different amplitudes.
Figure 3:
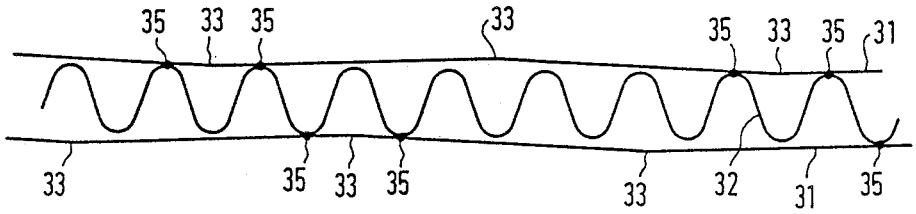
Figure 4:
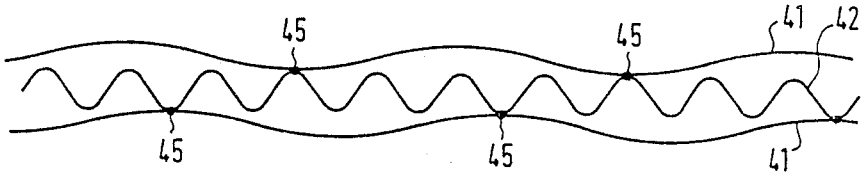
Figure 5:
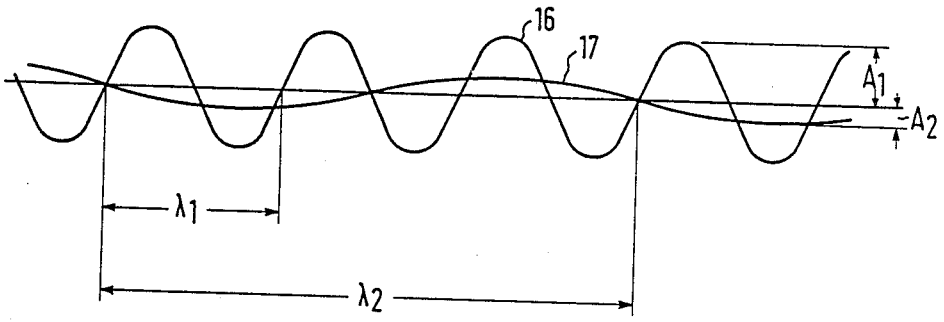
Figure 6:
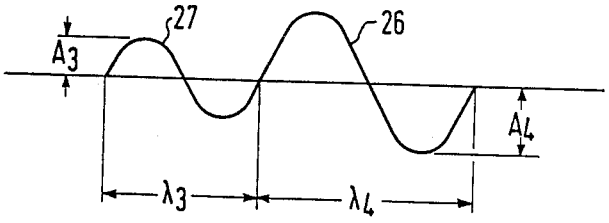

FIGS. 3 and 4 are front-elevational views of preferred embodiments of the invention having two sheet-metal layers corrugated to different extents, with FIG. 3 showing one sheet-metal layer corrugated in zig-zag fashion while FIG. 4 shows both sheet-metal layers having an approximately sinusoidal form; and FIGS. 5 and 6 are graphical illustrations of the double corrugations, waves or undulations of FIGS. 1 and 2 in greater detail.

The drawings diagrammatically illustrate preferred embodiments of the invention, in the form of small, greatly enlarged portions of one lamination at a time. For the sake of simplicity, the portions have not been shown in curved form, as they would actually appear in spirally rolled catalyst carriers or supports.

Referring now to the figures of the drawings in detail, and first, particularly to FIG. 1 thereof, there is seen a small, straightened-out portion of a catalyst carrier body or support body according to the invention. The body is formed of alternating rolled or laminated flat metal sheets 11 and double-corrugated metal sheets 12. The double corrugation, wave or undulation has wave crests 13, which do not touch the adjacent layer 11 and wave crests 14 of greater amplitude, which do touch the adjoining flat layer 11. It is thus clear that both the maxima and minima are reffered to as crests. The points of contact 15 can be connected by a joining technique. Since not every wave crest is connected to the adjoining flat sheet 11, an elastic structure is created, which can compensate for expansion.

The creation of a double corrugation of this kind can be illustrated as shown in FIG. 5. By superimposing a wave 16 having a wavelength $\lambda_1$ and an amplitude $A_1$ on a wave 17 having a wavelength $\lambda_2$ and a amplitude $A_2$, the desired double corrugation is created. It should be noted that the ratio of the amplitude $A_1$ to $A_2$ should be greater than 5:1 and preferably should be 10:1. The wavelength $\lambda_2$ should be a multiple of one half the wavelength $\lambda_1$, because in that case it is possible to produce such a structure by using toothed rollers. With other manufacturing methods, an exact ratio of the wavelengths is not absolutely necessary.

In FIG. 2, a somewhat different form of double corrugation for a corrugated sheet 22 between layers of flat sheets 21 is shown. In this embodiment, waves 23 or small amplitude alternate with waves 24 of large amplitude, so that once again not of all of the wave crests touch the adjoining flat sheet-metal layer 21. The points of contact 25 can again be connected by a joining technique. The question of how many half waves of small amplitude and how many half waves of large amplitude alternate with one another, depends on the elasticity required for a given application.

FIG. 6 illustrates the basic construction of such a double-corrugation or wave structure. One or more half waves 27 having small amplitude $A_3$ alternate with one or more half waves 26 having a large amplitude $A_4$. In addition, the wavelength $\lambda_3$ of the wave 27 having the small amplitude $A_3$ and the wavelength $\lambda_4$ of the wave 26 having the large amplitude $A_4$ can be different, depending on the requirements and on the manufacturing method used. This double-corrugation or wave structure can again be produced, for instance, with the aid of intermeshing toothed rollers.

FIG. 3 shows another embodiment of the invention, in which both sheet-metal layers 31, 32 have a wave or corrugated structure. One band 31 has a zig-zag structure with kinks 33 while the other sheet-metal band 32 has a typical corrugation, wave or undulation. The zig-zag corrugation of one sheet-metal band 31 has a very much greater wavelength and a very much smaller amplitude than the corrugation of the other sheet-metal band 32. The wavelengths and amplitude ratios need not be defined exactly, because the two corrugations are produced separately and the amplitudes can still be varied by suitable biasing during the rolling process. The result, once again, is a structure in which not all of the wave crests touch the adjoining sheet-metal layers, so that only individual points of contact 35 appear, which may optionally be connected by a joining technique.

FIG. 4 illustrates an embodiment which is quite similar to FIG. 3, but in which both metal sheets 41, 42 are corrugated in an approximately sinusoidal pattern, even though, as above, they have different wavelengths and amplitudes. In FIG. 4, the amplitude of the less-wavy sheet 41 is greatly exaggerated, so as to illustrate the principle clearly. When metal sheets of this kind are rolled up in spiral fashion, the individual locations of the contact points 45 of the sheets change because of the increasing circumference of the individual layers; overall, however, this does not limit the properties of the resultant catalyst carrier or support body.

The straightened-out portions shown in the drawing illustrate the essence of the invention in idealized form. When metal sheets which are structured in this way are rolled up, the number of contact points can also increase; however, there are still enough free spaces to assure the elasticity of the rolled body.

The catalyst carrier or support bodies according to the invention have a longer service life than conventional types, because even when installed in a solid tubular jacket, they are better capable of absorbing expansion, as a result of their elasticity. It is usually sufficient for only a relatively small area, for instance 5–10 layers, preferably in the outer region, to be provided with the multiple structure according to the invention, while the remaining areas can be shaped as before. For instance, in order to manufacture the multiple structure in such cases, it is suitable to use toothed rollers that can be interconnected and which provide one of the sheet-metal bands with an additional (longer-wavelength) corrugated or wavy structure, if needed.

I claim:

1. Metal catalyst carrier body, comprising two alternating layers of sheet metal having different structures at least partially formed of multiple corrugations, said layers having a wave structure with two waves of different wavelength and amplitude including a wave of greatest amplitude, one of said layers having wave crests some of which contact the other of said layers of defining contact points therebetween and some of which are spaced from the other of said layers providing a desired elasticity of the resultant structure, said wavelengths all being at least substantially as large as said wavelength of said wave of greatest amplitude, the wave structure of one of said layers having an amplitude being smaller than the amplitude of the wave structure of the other of said layers, and the wave structure of said layer having the smaller amplitude having a wavelength being greater than the wavelength of the wave structure of said layer having the greater amplitude.

2. Metal catalyst carrier body, comprising two alternating layers of sheet metal having different structures at least partially formed of multiple corrugations, one of said layers having a wave structure with at least two mutually superimposed waves of different wavelength including a wave of greatest amplitude, one of said layers having wave crests some of which contact the other of said layers defining contact points therebetween and some of which are spaced from the other of said layers providing a desired elasticity of the resultant structure, and said wavelengths all being at least substantially as large as said wavelength of said wave of greatest amplitude.

3. Metal catalyst carrier body, comprising two alternating layers of sheet metal having different structures at least partially formed of multiple corrugations, one of said layers having a wave structure with at least two mutually alternating waves of different amplitude including a wave of greatest amplitude, and one of said layers having wave crests some of which contact the other of said layers defining contact points therebetween and some of which are spaced from the other of said layers providing a desired elasticity of the resultant structure, said wavelengths all being at least substantially as large as said wavelength of said wave of greatest amplitude.

4. Catalyst carrier body according to claim 1, wherein said layers are rolled together.

5. Catalyst carrier body according to claim 2, wherein said layers are rolled together.

6. Catalyst carrier body according to claim 3, wherein said layers are rolled together.

7. Catalyst carrier body according to claim 1, wherein said layers are laminated together.

8. Catalyst carrier body according to claim 2, wherein said layers are laminated together.

9. Catalyst carrier body according to claim 3, wherein said layers are laminated together.

10. Catalyst carrier body according to claim 2, wherein said double-corrugated sheet has the structure of first and second superimposed waves, said first wave having a greater amplitude than said second wave and said second wave having a wavelength being a multiple of one-half the wavelength of said first wave.

11. Catalyst carrier body according to claim 1, wherein said layers are interconnected at said contact points.

12. Catalyst carrier body according to claim 1, wherein said layers are brazed together at said contact points.

13. Metal catalyst carrier body, comprising two alternating layers of sheet metal having different structures at least partially formed of multiple corrugations, one of said layers being a flat metal sheet having a wave structure with at least two waves of different wavelength and amplitude including a wave of greatest amplitude and the other of said layers being a double-corrugated sheet, said one of said layers having wave crests some of which contact the other of said layers defining contact points therebetween and at least half of which are spaced from the other of said layers providing a desired elasticity of the resultant structure, and said wavelengths all being substantially as large as said wavelength of said wave of greatest amplitude.

14. Catalyst carrier body according to claim 13, wherein said double-corrugated sheet has the structure of two alternating waves of different amplitude and at least one multiple of a half-wavelength of each of said waves alternate.

15. Catalyst carrier body according to claim 13, wherein said double-corrugated sheet has the structure of two alternating waves of different amplitude and different wavelength and at least one multiple of a half-wavelength of each of said waves alternate.

16. Catalyst carrier body according to claim 13, wherein said double-corrugated sheet has a structure produced by means of intermeshing toothed rollers having different tooth depths.

* * * * *